US005427163A

United States Patent [19]

Gönner et al.

[11] Patent Number: 5,427,163

[45] Date of Patent: Jun. 27, 1995

[54] METHOD AND INSTALLATION FOR CUTTING SQUARED TIMBER INTO BOARDS OF A PREDETERMINED THICKNESS

[75] Inventors: Siegmar Gönner; Heinz-Hubert Braun, both of Oberkirch, Germany

[73] Assignee: Firma Gebruder Linck, Germany

[21] Appl. No.: 166,249

[22] Filed: Dec. 13, 1993

[30] Foreign Application Priority Data

Dec. 28, 1992 [DE] Germany ..... 42 44 310.5

[51] Int. Cl.[6] ..... B27L 7/00; B27C 9/00

[52] U.S. Cl. ..... 144/369; 144/1 R; 144/3 P; 144/120; 144/175; 144/367

[58] Field of Search ..... 144/1 R, 2 R, 3 R, 3 P, 144/120, 164, 175, 114 R, 184, 190, 367, 369

[56] References Cited

U.S. PATENT DOCUMENTS

| | | | |
|---|---|---|---|
| 1,009,688 | 11/1911 | Peterson et al. | 144/120 |
| 1,107,810 | 8/1914 | Loveland | 144/120 |
| 1,503,704 | 8/1924 | Dumont | 144/3 P |
| 3,783,917 | 1/1974 | Mochizuki | 144/175 |
| 4,220,185 | 9/1980 | Traben | 144/3 P |
| 4,589,456 | 5/1986 | Traben | 144/3 P |
| 4,825,917 | 5/1989 | Gönner et al. | 144/3 P |
| 5,010,934 | 4/1991 | Mochizuki et al. | 144/175 |
| 5,052,452 | 10/1991 | Goenner | 144/3 P |
| 5,318,083 | 6/1994 | Gönner et al. | 144/175 |

*Primary Examiner*—W. Donald Bray

*Attorney, Agent, or Firm*—Marshall, O'Toole, Gerstein, Murray & Borun

[57] ABSTRACT

The present invention concerns a method for cutting squared timber into a number of thin boards. Individual boards 32 are cut off by a blade 30 from the squared timber in each of the successive cutting machines 14*a–g*, essentially in longitudinal direction of the squared timber. The thickness of the squared timber 26 is selected in such a way that, once an integral number of boards having a predetermined thickness are cut off, a residual board remains which is reduced to the same thickness d as the boards 32 by shaving. The shaving preferably takes place by placing a planer 18 after the last cutting machine 14*g*. The installation 10 is equipped with a material feed 12 and a conveying system 20 for removing the cut boards, the cutting machines and the planer are also connected to one another by conveying devices 16, 24.

16 Claims, 2 Drawing Sheets

Figure 1:
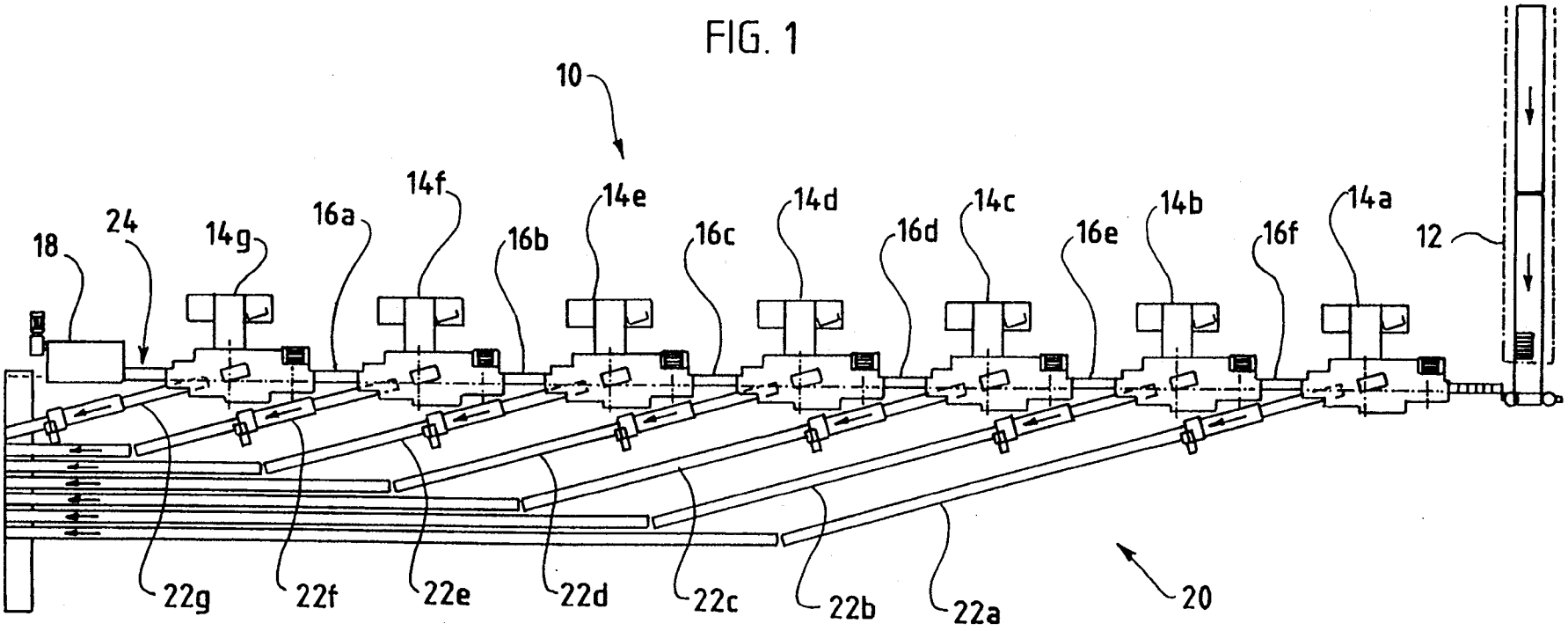

METHOD AND INSTALLATION FOR CUTTING SQUARED TIMBER INTO BOARDS OF A PREDETERMINED THICKNESS

The invention concerns a method for cutting squared timber into a number of thin boards of a predetermined thickness according to the preamble of claim 1. In addition, the invention concerns an installation for carrying out said method.

The production by cutting of relatively thin boards from squared timber or a device therefor are known, for example, from DE-A 37 02 909.

If thin boards are being made into laminate products such as laminated panels, wall and floor panels or adhesive binders, for the production of which they are usually joined into layers having a larger surface area, it is necessary that the thin boards to be worked have, if possible, a uniform thickness so that there are no surface variations in the joined layers. Different layers can, on the other hand, have different thicknesses. If thin boards are produced by sawing a squared timber, then the thicknesses of the boards can be predetermined or set generally relatively acccurately by adjusting the saw blades accordingly. The required initial thickness of a squared timber for producing a specific number of boards of the same thickness can also be predetermined relatively accurately by, in addition, taking the thickness of the cutting grooves of the saw into consideration.

When producing boards by cutting, the actual thickness of a board obtained is dependent on various procedural parameters, among others also the respective condition of the wood, so that it is often only possible to adjust the blade setting after a cut board has been measured in order to correct the thickness of boards subsequently cut off from a squared timber.

A method for correcting the thickness in this way is, for example, described in DE-A 40 26 346. Often, only one or two cutting machines are used in board cutting installations with a lower output. After one or two boards have been cut off in two cutting machines directly behind one another, the squared timber is usually returned in a circuit to the front of the machines so that it can travel through the machines again until it is completely cut up into the thin boards to be produced. There is sufficient time in this procedure to correct the blade setting prior to the next passage of the squared timber through the machines after the thickness of a cut board has been measured.

In installations having a high output, one preferably arranges as many cutting devices or cutting machines directly in a row, one behind the other, as required to enable a squared timber of a specific thickness to be completely cut up into thin boards having the desired predetermined thickness in a, for the most part, straight passage through the installation. If one, moreover, takes into consideration that one works at cutting speeds of 90–140 m/min and more nowadays when producing thin boards by cutting, then the time required for a squared timber to travel through a series of cutting devices located one behind the other so that it is completely cut up becomes so short that measurement of a board produced by a cutting device, and a resultant correction of the blade setting on the next cutting device, can no longer be carried out at a justifiable expense. This possibility is almost completely precluded when several squared timbers are led through the series of cutting devices in immediate succession. The blade correction could then only take place while a board is being cut off, as a result of which its thickness would be uneven over its entire length.

Thus, it is the object of the invention to propose a method and an installation with which it is possible to produce boards of a predetermined thickness, even in cutting devices arranged in series behind one another, which cut a squared timber into thin boards in one passage through the machines.

According to the invention, this object is solved by the characterizing features of claim 1 with respect to the method and by the characterizing features of claim 3 with respect to the equipment.

The great advantage of producing thin boards by cutting lies therein that up to 40% of the raw material wood can be saved when compared to a production in which squared timber is sawed into pieces, since there is no sawdust in a cutting production. However, this advantage could be made useless if cut boards produced at a high production output for manufacturing laminate products cannot be used because the thickness constancy of the boards cannot be completely controlled.

For this reason, according to the invention, allowance is made for some shaving of the residual board. Theoretically, it would also be possible to size the squared timber somewhat thicker than required so as to obtain a thin residual board in the last cutting device which is discarded. However, there are limits to this method because a very thin, final cutting, i.e. a cutting which is thinner than the minimum lamellar thickness which can be produced by the cutting machine, can no longer be handled in the cutting machines as a so-called residual board. Also, proceeding in such a way that a thin excess layer is cut off in the last cutting device from the remaining squared timber fed to it and that the remaining squared timber leaving the last cutting device is used as a last board is not possible in practice since only the thickness of the cut layer can be determined in the cutting devices by the distance between contact surface for the squared timber and the blade. Thus, if one only wanted to cut off a thin layer from the remaining squared timber fed to the last cutting device, then the thickness of this remaining squared timber would first have to be measured in order to determine the thickness of the layer to be cut off from it and to adjust the blade accordingly. However, this is the step which cannot be managed at justifiable expense with high speeds and squared timbers following in immediate succession. Furthermore, it could be that the remaining squared timber fed to the last cutting device is no longer fully parallel in its main surfaces after several boards have been cut off it. As a result, if a thin excess layer is cut off, then it would be cut with the same thickness and the crookedness would remain in the last board.

Thus, however, the object of the invention is optimally solved thereby, contrary to the rules of avoiding waste shavings, that the advantage of producing boards by cutting is relinquished to a small extent. By subsequently shaving the resultant residual board in such a way that a joined wood layer is not cut off—and the term "shaving" should be understood in this way—there is ultimately less waste to be dealt with than if one had to discard a residual board when systematically carrying out the cutting technology, said board having to be thicker in any event than the maximum excess required for the subsequent shaving.

Preferably, the shaving takes place by planing, that is, in such a way that the residual board is guided with one of its main surfaces on a contact surface and the shaving removal takes place on the other side. If the residual board is not parallel, this can also be restored as a result.

Cutting machines which have proved successful in practice are constructed in such a way that the squared timber is guided on a supporting table and pressed against a blade edge which is located above the table at a distance equal to the thickness of the board to be produced. The back of the blade is thereby used as a support surface for the remaining squared timber reduced by one board thickness and the board produced is led off diagonally downward through the gap between the first supporting surface and the blade edge and finally laterally removed from the machine.

It is also feasible that a cutting machine contains several cutting devices in succession or that boards are cut off simultaneously from two sides of a squared timber, however, current practice is such that each cutting device is part of a separate cutting machine.

Since the squared timbers are guided on a horizontal table when passing through the cutting machines, an arrangement presents itself in which a series of cutting machines are arranged essentially in immediate succession, whereby the cutting machines are only connected to one another by conveyors or feeding devices for the squared timber and the squared timber can thus be guided through the series of machines in a straight line. Since the residual board to be shaved is essentially the remaining squared timber leaving the last cutting device which, as a result, does not have to be laterally led off from the cutting machines as the previously cut boards, the shaving device can also immediately follow the series of cutting machines in continuation of the straight direction of conveyance of the squared timber.

An installation having a series of cutting machines is preferably arranged in such a way that squared timber of a specific maximum thickness can be cut into a specific number of thin boards in one run-through. If, deviating from this arrangement, fewer boards are to be produced in a run, then the installation is advantageously equipped in such a way that the residual board travels through the last cutting machines which are not required, without a wood layer being cut off from it. For this reason, the last cutting machines of a series of machines in question for the idle-run are to be equipped in such a way that their blades can be set to a board thickness of 0 mm, i.e. that the blade edge can be brought into the plane of the supporting table or below it. The frictionless idle run-through of a residual board through a cutting machine can also be impeded by the counterpressure gibs which are located in front of each blade and rising out of the supporting table. In an advantageous embodiment of the invention, the machines intended for the idle run-through are, in addition, also equipped in such a way that the counterpressure gibs can be driven back into the plane of the supporting table or also below it.

The unhindered passing of the residual board through a cutting machine can also be assured in such a way that the cutting blade is replaced by a blank plate which has no cutting edge. The blank plate has the same dimensions as the cutting blade, so that, once the blank plate has been inserted, there is a completely level support and guide surface for the residual board.

An example of an embodiment of an installation is described in the following with which squared timbers can be cut into a number of thin boards having the same thickness.

Figure 2:
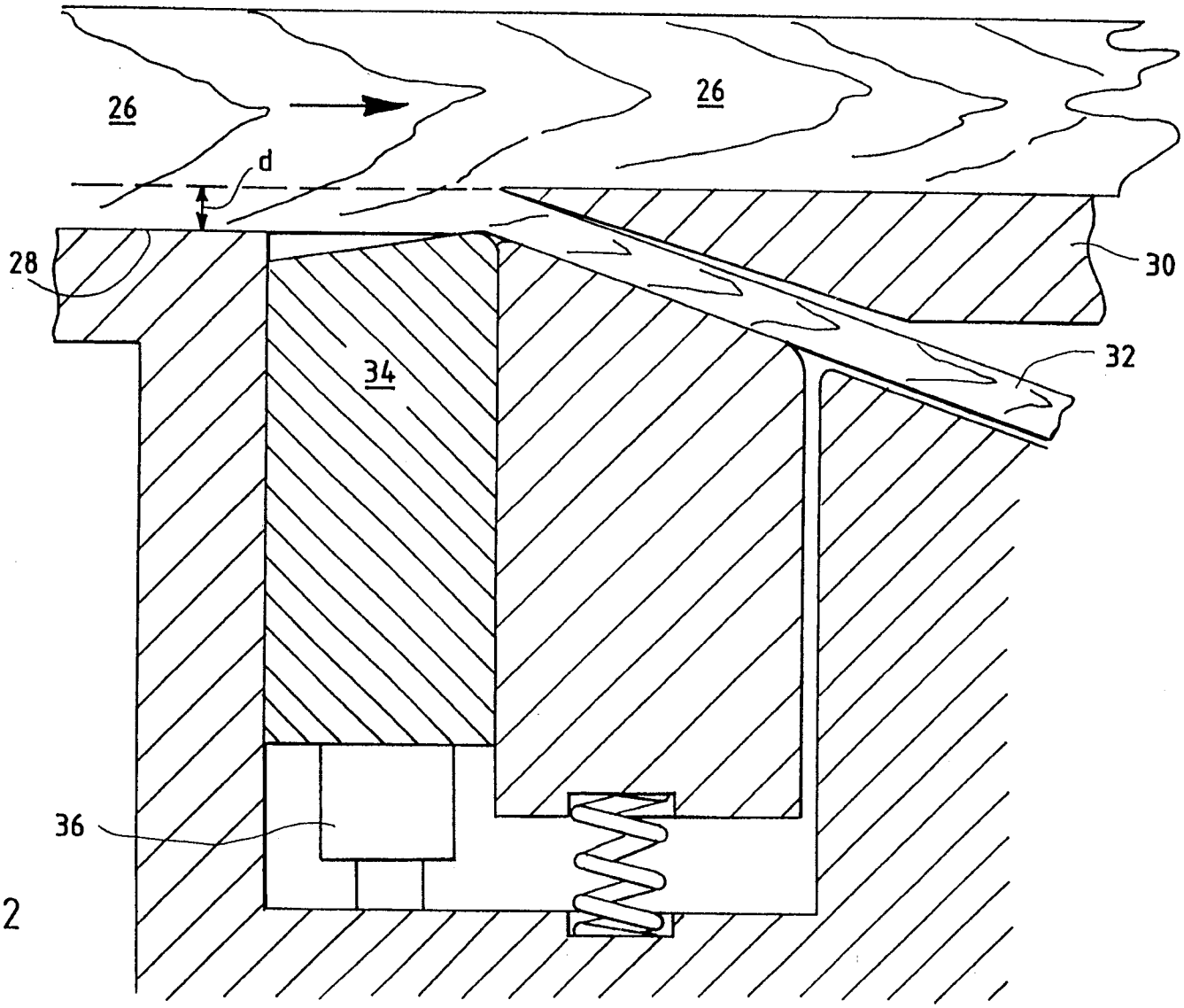

The drawings show:

FIG. 1 a schematically illustrated installation for cutting a squared timber into a number of thin boards having a predetermined thickness, FIG. 2 a section through the blade area of a cutting machine.

An installation 10 for cutting squared timbers 26 is composed of a material feed 12, a number of cutting machines 14*a–g* arranged behind one another and connected to one another by conveying devices 16*a–f*, a planing machine 18 disposed behind the last cutting machine 14*g* and a conveying system 20 for conveying the cut boards 32.

The material feed 12 can be in the form of a gravity-roller conveyor in which at least a part of the rollers are driven, however, it can also be, as shown here, in the form of a conveyor belt on which squared timber 26 can be fed to the cutting machine 14*a–g*. The squared timbers 26 are then guided through the cutting machines 14*a–g* in longitudinal direction at high speed, at least 90 m/min, preferably about 140 m/min, up to a maximum of 220 m/min. The cutting machines 14*a –g* have their own feeding or conveying devices. Conveyor belts 16*a–f*, as shown here, or also gravity-roller conveyors are arranged between each of the cutting machines 14*a–g* for transporting the squared timber 26 further. An outlet 22*a–g* for the cut boards 32 branches off from each cutting machine 14*a–g*. These outlets are part of the conveying system 20, by means of which the cut boards 32 are forwarded to the further processing. In this case also, gravity-roller conveyors or, as shown, conveyor belts can be used.

The planing machine 18 adjoins the last cutting machine 14*g* via a further conveying device 24. The residual board calibrated in the planer 18 is also guided to the conveying system 20 and thus to the same further processing as the other boards 32.

The installation 10 is operated such that a squared timber 26 is led to the first cutting machine 14*a* via the material feed 12. As can be seen in FIG. 2, the squared timber 26 is guided on a horizontal contact surface 28 in the cutting machine 14*a* to the blade 30, situated above the plane of the contact surface. The blade 30 cuts off a board 32 having a predetermined thickness d which is conveyed away downward. In order to attain the best possible cutting path, a counterpressure gib 34, which protrudes a bit from the contact surface 28, is placed directly in front of the blade edge in cutting direction in the contact surface 28. The counterpressure gib 34 thus exerts point-focal pressure onto the squared timber 26, so that the split in the squared timber 26, produced by the blade edge, cannot expand uncontrollably.

In this way, a board 32 having a predetermined thickness d is cut off from the underside of each squared timber 26 in each of the cutting machines 14*a–g* laid out. Thus, the thickness of the squared timber 26 decreases by the amount of the board thickness d each time it travels through a cutting machine 14*a–g*.

The number of cutting machines 14*a–g* arranged behind one another depends on the maximum number of boards 32 which are to be cut from a squared timber 26. If squared timbers 26 having a slighter thickness are cut so that there are fewer boards 32 or if thicker boards 32 are cut from squared timbers 26 having the same thickness so that there are again fewer boards 32, then it could be that the residual board to be planed must pass through one or more cutting machines 14*a–g* without a board 32 being cut off there. As usual, the residual board is thereby guided via the contact surface 28 of the cutting machines 14*a–g*. However, this even conveying surface would be interrupted in a disturbing manner by the protruding counterpressure gib 34 which becomes functionless as soon as no board 32 is cut off in the cutting machine 14*a–g*. For this reason, the counterpressure gib 34 is made so as to be displaceable, so that it can be lowered at least into the plane of the contact surface 28 when only one residual board passes through the cutting machine 14*a–g* without a board 32 being cut off from it. The slide mounting 36 can be in the form of, for example, a hydraulic mounting or also a mechnanical mounting.

The same blade position and the lowering of the counterpressure side can be selected when any one of the series-connected machines is passed through without a cutting action, e.g. for maintenance work.

According to the method of the invention, a squared timber 26 is cut into a number n of boards 32 in the installation 10. After having travelled through several cutting machines 14*a–g* in which n-1 boards 32 have been cut off, a so-called residual board remains which has, according to the method, a thickness which is slightly greater than the thickness d of the boards 32. After cutting off n-1 boards 32, the residual board is either led directly to the planer 18 or it passes through an additional cutting machine 14*a–g* without, however, any boards 32 being cut off, in order to then be led to the planer 18 via the conveying device 24.

In spite of precisely set cutting machines 14*a–g*, it could happen that this residual board no longer has a uniform thickness. Since the surface of the squared timber 26 resting on the contact surface 28 was always worked, this bottom surface resting on the contact surface 28 can be considered to be even. Any irregularities in the thickness of the residual board are therefore advantageously removed from the upper side of the residual board.

The planer 18 is preferably equipped with planer blocks located at the top relative to the residual board. The planer blocks are laid out in such a way that they reduce the residual board to the predetermined thickness d by removing individual wood shavings.

The loss of material due to the removal of wood shavings is less than if a residual board, whose thickness dl would be less than the predetermined thickness d, were to be cut off in a last cutting machine 14*a–g*.

What is claimed is:

1. Method for cutting squared timber (26) into a plurality of thin boards (32) comprising the steps of:

providing at least one blade for cutting a thin board from squared timber;

providing a squared timber (26) having a thickness with respect to a direction vertical to a cutting plane of the blade (30), said thickness being larger than a sum of thicknesses of a selected number of individual boards (32) to be cut from the squared timber;

cutting the squared timber into said selected number of individual boards (32) in succession with said blade (30), each of said individual boards having a predetermined thickness, said blade cutting essentially in a longitudinal direction of the squared timber (26); and reducing a residual board remaining after the cutting of the selected number of individual boards to a predetermined thickness by shaving.

2. Method according to claim 1, characterized therein that the residual board is reduced to this predetermined thickness by planing.

3. Installation for cutting a squared timber (26) into a plurality of thin boards (32), each board having a predetermined thickness, said installation comprising:

a series of cutting devices (14*a–g*), arranged in succession, each of said cutting devices for clean cutting one board (32) of a predetermined thickness from one side of the squared timber (26); and a shaving device (18) disposed downstream of the series of cutting devices (14*a–g*) with respect to a direction of travel of the squared timber through the cutting devices, said shaving device for reducing the thickness of a residual board of the squared timber (26) coming from the series of cutting devices (14*a–g*).

4. Installation according to claim 3, characterized therein that the device for shaving is a planing machine (18).

5. Installation according to claim 3, characterized therein that each cutting device of the series of cutting devices (14*a–g*) is part of a separate cutting machine and that the cutting machines are arranged in a series, one after the other.

6. Installation according to claim 5, characterized therein that conveying devices (16*a–f*) are provided between the cutting machines (14*a–g*) for forwarding the squared timber (26) or each remaining squared timber further, essentially in a straight line, in its longitudinal direction through the series of cutting machines (14*a–g*) and that, behind the last cutting machine, a conveying device (24) is provided for immediately forwarding the last remaining squared timber forming the residual board directly into the shaving device planer (18).

7. Installation according to claim 3, whose cutting devices (14*a–g*) have a contact surface (28) for guiding the squared timber (26), a blade (30) adjustable to a distance "d" from the contact surface (28) in direction of the squared timber (26), seen in conveying direction of the squared timber (26) behind the contact surface (28), and a counterpressure gib (34) placed in front of the blade (30) which protrudes slightly from the contact surface (28), characterized therein that the blade (30) and the counterpressure gib (34) of at least one cutting device (14*a–g*) can be moved back into or below the contact surface (28) so that the squared timber (26) can travel through it without cutting off a board (32).

8. Installation according to claim 3, characterized therein that the blade (30) can be replaced by a blank plate in at least one of the cutting devices (14*a–g*), said blank plate forming an even surface with the contact surface (28).

9. Installation according to claim 4, characterized therein that each cutting device of the series of cutting devices (14*a–g*) is part of a separate cutting machine and that the cutting machines are arranged in a series, one after the other.

10. Installation according to claim 9, characterized therein that conveying devices (16*a–f*) are provided between the cutting machines (14*a–g*) for forwarding the squared timber (26) or each remaining squared timber further, essentially in a straight line, in its longitudinal direction through the series of cutting machines (14*a–g*) and that, behind the last cutting machine, a conveying device (24) is provided for immediately forwarding the last remaining squared timber forming the residual board directly into the shaving device planer (18).

11. Installation according to claim 4, whose cutting devices (14*a–g*) have a contact surface (28) for guiding the squared timber (26), a blade (30) adjustable to a distance "d" from the contact surface (28) in direction of the squared timber (26), seen in conveying direction of the squared timber (26) behind the contact surface (28), and a counterpressure gib (34) placed in front of the blade (30) which protrudes slightly from the contact surface (28), characterized therein that the blade (30) and the counterpressure gib (34) of at least one cutting device (14*a–g*) can be moved back into or below the contact surface (28) so that the squared timber (26) can travel through it without cutting off a board (32).

12. Installation according to claim 4, characterized therein that the blade (30) can be replaced by a blank plate in at least one of the cutting devices (14*a–g*), said blank plate forming an even surface with the contact surface (28).

13. Installation according to claim 5, whose cutting devices (14*a–g*) have a contact surface (28) for guiding the squared timber (26), a blade (30) adjustable to a distance "d" from the contact surface (28) in direction of the squared timber (26), seen in conveying direction of the squared timber (26) behind the contact surface (28), and a counterpressure gib (34) placed in front of the blade (30) which protrudes slightly from the contact surface (28), characterized therein that the blade (30) and the counterpressure gib (34) of at least one cutting device (14*a –g*) can be moved back into or below the contact surface (28) so that the squared timber (26) can travel through it without cutting off a board (32).

14. Installation according to claim 5, characterized therein that the blade (30) can be replaced by a blank plate in at least one of the cutting devices (14*a–g*), said blank plate forming an even surface with the contact surface (28).

15. Installation according to claim 6, whose cutting devices (14*a–g*) have a contact surface (28) for guiding the squared timber (26), a blade (30) adjustable to a distance "d" from the contact surface (28) in direction of the squared timber (26), seen in conveying direction of the squared timber (26) behind the contact surface (28), and a counterpressure gib (34) placed in front of the blade (30) which protrudes slightly from the contact surface (28), characterized therein that the blade (30) and the counterpressure gib (34) of at least one cutting device (14*a –g*) can be moved back into or below the contact surface (28) so that the squared timber (26) can travel through it without cutting off a board (32).

16. Installation according to claim 6, characterized therein that the blade (30) can be replaced by a blank plate in at least one of the cutting devices (14*a–g*), said blank plate forming an even surface with the contact surface (28).

* * * * *